US005263093A

United States Patent [19]

Nakamura et al.

[11] Patent Number: 5,263,093

[45] Date of Patent: Nov. 16, 1993

[54] MICROPHONE DEVICE IN USE IN FOR COMMUNICATION APPARATUS FOR MOTORCYCLE

[75] Inventors: Shigehira Nakamura, Tokyo; Shigenori Takeda, Yamagata, both of Japan

[73] Assignee: Kabushiki Kaisha Honda Access, Saitama, Japan

[21] Appl. No.: 828,179

[22] Filed: Jan. 30, 1992

[30] Foreign Application Priority Data

Jan. 30, 1991 [JP] Japan ..... 3-8543[U]

[51] Int. Cl.[5] ..... H04R 25/00

[52] U.S. Cl. ..... 381/168; 381/177; 381/92

[58] Field of Search ..... 381/168, 169, 158, 187, 381/205, 155, 177, 92

[56] References Cited

U.S. PATENT DOCUMENTS 3,943,304 3/1976 Piribaurer ..... 381/187

4,058,688 11/1977 Nishimura et al. ..... 381/158

FOREIGN PATENT DOCUMENTS 1183134 12/1964 Fed. Rep. of Germany ..... 381/155

*Primary Examiner*—Jin F. Ng

*Assistant Examiner*—Huyen D. Le

[57] ABSTRACT

In a close talking microphone device in use for a communication apparatus for a motorcycle, a front casing 2 and a back casing 3 are provided with a front opening 7 and a back opening respectively. Elastic supporting members 5, 6 and 15 for a microphone 4 are accommodated through a first and second filters 11 and 12 between the front casing 2 and the back casing 3 and formed thereon with first, second and third through holes 13, 14 and 16 connected to each other. The microphone 4 is engaged within the third through hole to form a pair of sound paths at each front and back side of the microphone 4. The front sound path is smaller in volume than the back sound path and the opening size of the through hole 13 is defined narrower than that of the through hole 14, whereby a sideward noise diverges into two courses "a" and "b" and the diverging noises reaching the microphone are cancelled by each other so as to be dampened.

6 Claims, 7 Drawing Sheets

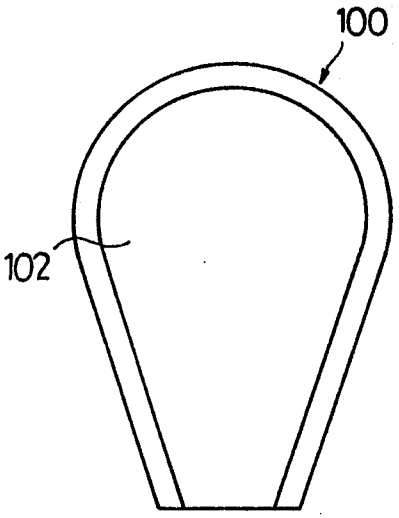
PRIOR ART FIG.8 (C)
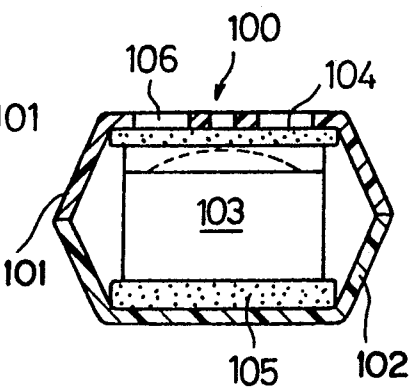
PRIOR ART FIG.8 (B)
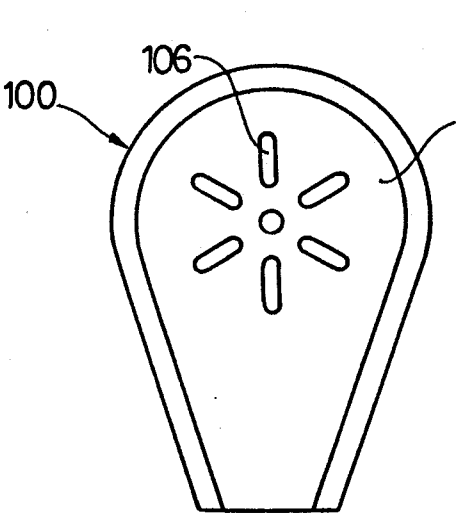
PRIOR ART FIG.8 (A)

MICROPHONE DEVICE IN USE IN FOR COMMUNICATION APPARATUS FOR MOTORCYCLE

BACKGROUND OF THE INVENTION

1. Field of the Invention

The present invention relates to a microphone device for use in a communication apparatus for a motorcycle, and more particularly to a type of a microphone device for close positioning relative to a user which is mounted on an operator's helmet or the like to transmit a message for example during driving operation of a motorcycle.

2. Description of the Background Art

FIG. 8 illustrates a microphone device of the above mentioned close talking type (hereinafter, referred to as "close talking microphone device) as an example. In the drawing, FIG. 8(A) is a front view of the close talking microphone device 100, wherein the side facing an operator is referred to as the front of the microphone device and the reverse side is referred to as a back thereof. FIG. 8(B) shows a cross sectional view of the microphone device and FIG. 8(C) shows a back view thereof. As apparent from FIG. 8(B), the close talking microphone device 100 has a front casing 101 and a back casing 102 combined with each other to form an internal space therebetween in which a microphone 103 is accommodated. Elastic supporting means 104 and 105 are arranged at each front and back of the microphone 103 to support the latter in a floating condition. On the front casing 101, there is formed a plurality of slots 106 to communicate a message transmitting voice therethrough. As will be seen from FIG. 8(C), however, no slot is formed on the back casing 102. This microphone device 100 is low sensitive to a remote source of a sound than the message transmitting voice and has such a characteristic as not to be susceptible to pick up an environmental noise.

When the message transmitting voice is transmitted by the microphone device 100 during a driving operation of a motorcycle, the environmental noise is susceptible to be picked up. The environmental noise includes a noise generated by a running operation and an outside noise. The noise in the running operation includes a contact noise between wheels and a road, a noise of an engine operation and a noise caused from a ram air. On the other hand, the outside noise includes other vehicle noise, which is generated by other vehicles running near by, especially side by side and a noise of road construction or the like.

In the motorcycle, a noise which is particularly an obstacle to the message transmission is a sideward noise such as other vehicle noise which is communicated from a direction of 90 degrees (sideward) with respect to an input direction of the message transmitting voice. To remove the sideward noise, it is necessary to employ the close talking microphone device which has such a directivity (directional characteristic) as to be low sensitive to the sideward noise. In this respect, it is effective for the microphone device to be provided with the directivity of substantially the shape of the number 8 as shown in FIG. 7.

SUMMARY OF THE INVENTION

Therefore, the present invention is made in view of the afore-mentioned knowledge and an object of the present invention is to provide an improved microphone device in use for a communication apparatus for a motorcycle which is capable of being effectively provided with the directivity of substantially the shape of the number "8".

To this end, according to the present invention, there is provided a close talking microphone device in use for a communication apparatus for a motorcycle comprises a front casing for positioning adjacent to a mouth of a message transmitter and being provided with an opening for transmitting a message transmitting voice, a back casing being adapted to be combined with the front casing in a face to face relationship to form a space for accommodating therein a microphone, an elastic supporting means being formed of an air ventilating material and being accommodated in the microphone accommodating space, and the microphone to be talked close thereto being adapted to be supported by the elastic supporting means in a floating state, characterized in that a vibrator plate of the microphone is provided with a central circular portion and an outer peripheral portion concentrically and integrally formed with the central circular portion, the outer peripheral portion being defined smaller in width than the central circular portion and formed with a surface of different curvature from the central circular portion, and a moving coil being engaged at an end thereof with a bent portion between the central circular portion and the outer peripheral portion of the vibrator plate, that a through hole is formed at the center of the elastic supporting means, the microphone being engagingly arranged within the through hole so as to divide the space of the through hole into a front sound path and a back sound path with respect to the vibrator plate of the microphone, and the front sound path being defined smaller in size and volume than the back sound path, and that the elastic supporting means is compressively accommodated within the space of the casing in such a state that the same is in abutment through a first filter with the front casing at the front end thereof and through a second filter with the back casing at the back end thereof, the back casing being formed with an opening thereon, and the through hole being in communication through the first and second filters with each opening of the front casing and the back casing.

In one aspect of the present invention, a central opening is formed on a center of the microphone so as to communicate between the back side of the vibrator plate and the backward area of the through hole with respect to the microphone.

In another aspect of the present invention, the microphone is provided with a flange for supporting the outer peripheral portion of the vibrator plate, a smaller hole being formed on the flange and positioned on an air ventilating elastic member, and the sound path is formed through the hole and the elastic member to communicate between the back side of the outer peripheral portion of the vibrator plate and the backward area of the through hole with respect to the microphone.

In still another aspect of the present invention, the elastic supporting member is formed with three separate pieces comprising a first elastic support which is in abutment through the first filter with said front casing, a second elastic support which is in abutment through the second filter with the back casing, and a third elastic support which is arranged between the first and second elastic supports so as to carry thereon the microphone. A first, second and third through holes are formed respectively on each center of the first, second and third elastic supports. The first through hole is defined smaller in diameter than the second through hole and the latter is defined smaller in diameter than the third through hole.

In yet another aspect of the present invention, the front casing and back casing are produced with a common die to be formed into a similar configuration with respect to each other.

The microphone is supported within the through hole formed with the elastic support means in such a state that the microphone is surrounded at the side periphery thereof by the air-tight elastic support means and communicated at the frontward and backward directions thereof to the outside. When the sideward noise caused from the common source reaches the periphery of the microphone, a part of the noise is divided and turns toward the front and the back of the microphone.

A noise component turning to the front enters from the opening of the front casing through the first filter into the front side of the through hole. On the other hand, a noise component turning to the back enters from the opening of the back casing through the second filter into the back side of the through hole. Each of the noise components diverging into the front side and the back side goes forward to the microphone from opposite directions within the through hole and reaches the front and the back of the vibrator plate so as to be reduced with respect to each other.

In order to explain the noise reducing system, FIG. 6 is a graph diagrammatically illustrating a characteristic of a sound pressure relative to each sideward noise component reaching the vibrator plate. A curve "c" shows a characteristic of a sound pressure at the front side of the vibrator plate. A reference character "d" shows a curve whose peak is reduced less than a threshold level of the vibrator plate by the first filter. A reference character "e" shows a curve which is caused by resonance in the front space, including the through hole, of the microphone. A curve "f" shows a characteristic of a sound pressure of each sideward noise component on the assumption that there is no reduction or resonance. The curve "c" is obtained by synthesizing the curves "d" and "e" and by making the curve "f" flat.

A curve "g" shows a sound pressure characteristic at the back side of the vibrator plate. Like the curve "c" above, the curve "g" is obtained by synthesizing a curve "h" whose peak is reduced to be less than a threshold level by the second filter and a curve "j" which is caused from a resonance within the back space of the microphone including the through hole, and by making flat a curve "k" shows a sound pressure characteristic of each sideward noise component without reduction and resonance.

As seen from the drawing, the curve "f" is different in substance from the curve "k", but since the front space is defined to be less in volume than the back space, the curves "c" and "g" have a similar form to each other. An opening area of the through hole at the front side is less than that at the back side and the sound pressure may become substantially even at both sides of the front and the back of the vibrator plate. Therefore, the curves "c" and "g" are substantially symmetrical to each other with respect to the vibrator plate. Thus, the diverging noises dampen each other when each of them reaches the vibrator plate so that the sideward noise may be remarkably reduced.

The vibrator plate is not susceptible to be operated by the lower sound pressure. Accordingly, the remarkably dampened sideward noise discussed above is hard to pick up and only the message transmitting voice of larger sound pressure coming from the front is more effectively picked up by the vibrator plate.

As mentioned heretofore, the directivity in this close talking microphone device may be in the form of substantially the shape of the number "8" as shown in FIG. 7 and a sensitivity in the sideward direction of the microphone device is remarkably reduced so that the sideward noise may be effectively removed.

The above and other related objects and features of the present invention will be apparent from the following description of the disclosure when the same is read in connection with the accompanying drawings.

BRIEF DESCRIPTION OF THE DRAWINGS

FIG. 8 is a schematical view showing the prior art.

DETAILED DESCRIPTION OF THE PREFERRED EMBODIMENT

Figure 2:
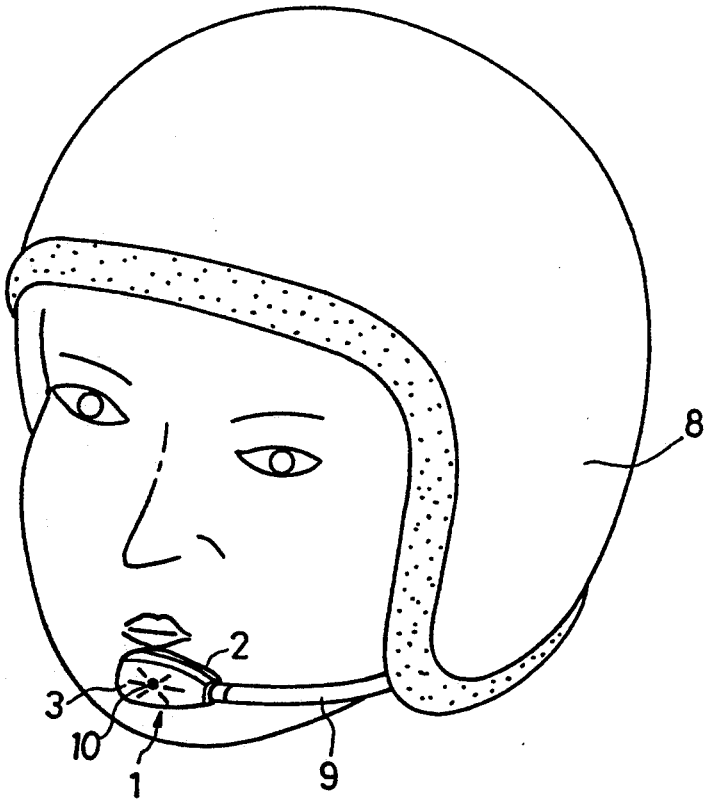
FIG. 2 is a perspective illustration showing an operative state.

Referring now to the drawings, FIG. 2 shows an operative state of an embodiment pursuant to the present invention, wherein a microphone device 1 is positioned close to the mouth of an operator. The microphone device 1 is mounted on an arm 9 which is supported on one side of a helmet 8 and extends toward the front thereof to have the microphone device 1 positioned close to a mouth of a message transmitting operator wearing the helmet 8. The sensitivity of this microphone device 1 has such a characteristic of the above mentioned close talking microphone that a microphone may be sensitive only to a comparatively close source of a sound or noise. A casing of the microphone device 1 is constituted with a front casing 2 and a back casing 3 formed with a pair of symmetrically opposed halves.

Figure 1:
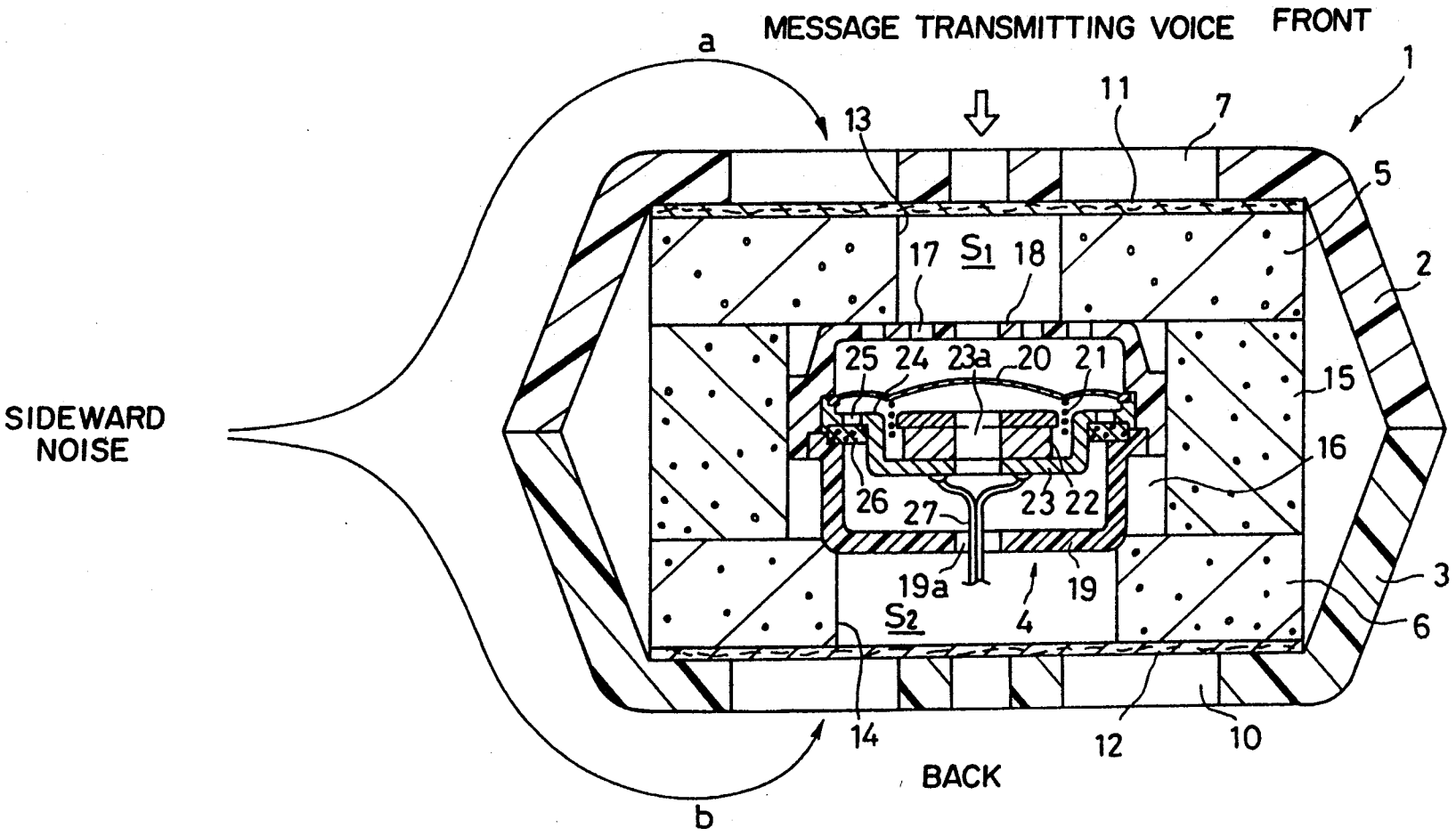
FIG. 1 is a transversely cross sectional view of an embodiment pursuant to the present invention.
Figure 3:
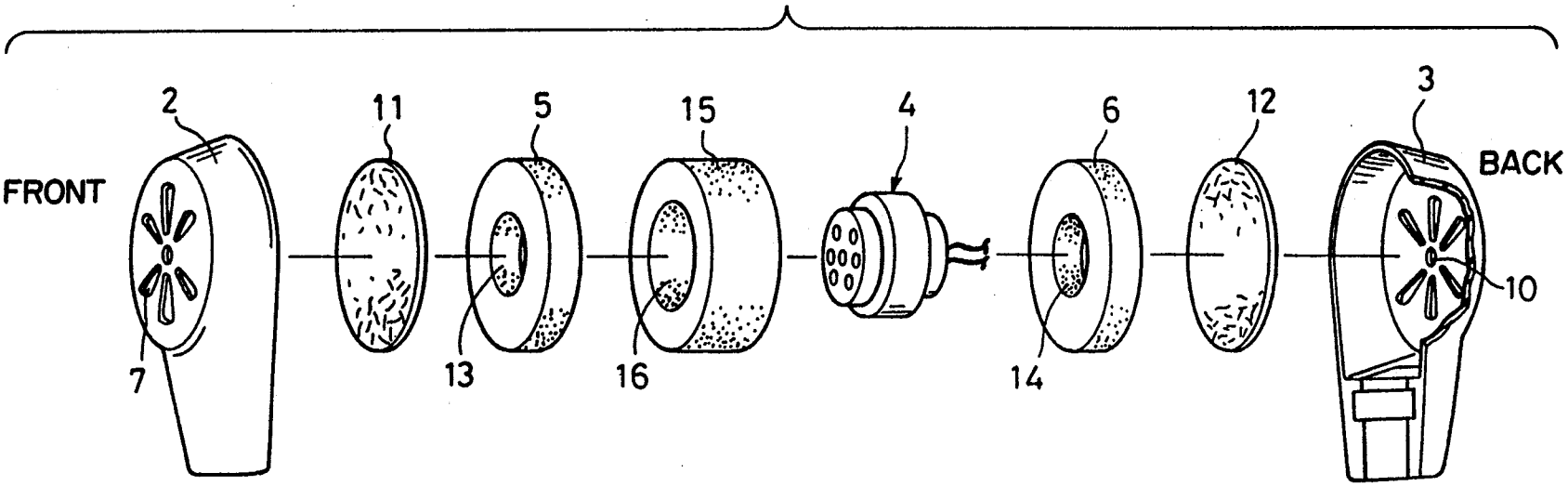
FIG. 3 is an exploded perspective view showing an essential part of the present invention.

FIG. 1 illustrates a cross sectional construction of the microphone device of this embodiment and FIG. 3 is an exploded illustration of its component parts. As apparent from these illustrations, the close talking microphone device is constituted with an outer and inner members. The outer member is formed with the front casing 2 and the back casing 3 which are produced with a common die to be formed into the same configuration. The inner member comprises a first, second and third elastic supporting members 5, 6 and 15 which support thereon a microphone 4 and a first and second filters 11 and 12. The front casing 2 and the back casing 3 are formed of the same material and, when combined with each other, define therein a space for accommodating the inner member. On each of the front casing 2 and the back casing 3 are formed a front opening slot 7 and a back opening slot 10 of the same configuration. These slots 7 and 10, however, are not required to be of a like configuration and may be formed in different configurations from each other.

The first and second filters 11 and 12 are each formed of porous material such as a sponge, fiber or the like possible to penetrate a sound therethrough. The first filter 11 is arranged between the front casing 2 and the first elastic supporting member 5. The second filter 12 is arranged between the back casing 3 and the second elastic supporting member 6. These first and second filters 11 and 12 are preset to dampen a peak of the sound pressure of the sideward noise to a lower level than a threshold level, as referred to in FIG. 6.

The first, second and third elastic supporting members 5, 6 and 15 are adapted to carry thereon the microphone 4 in a floating state and is formed of an air-tight material, for example, like a chloroprene rubber sponge. These elastic supporting members 5, 6 and 15 are piled in series in the longitudinal directions thereof and compressed to be interposed under preload between the front and back casings 2 and 3 so that they are arranged within the accommodating space of the casing as an integrally formed elastic support means for the microphone 4. The first and second elastic supporting members 5 and 6 are each formed of a doughnut shaped plate with the same external configuration and provided at each center thereof with axially extending through holes 13 and 14. The microphone 4 is supported at each front and back side thereof on the first and second elastic supporting members 5 and 6. The third elastic supporting member 15 is formed of a tubular shape with the same size in external diameter as the first and second supporting members 5 and 6 thereby to be arranged between them. The third supporting member 15 is provided at the center thereof with an axially extending through hole 16. The internal diameter of the through hole 16 is substantially the same as the external diameter of the microphone 4 so that the microphone 4 is held in close abutment at the external periphery thereof with the internal periphery of the through hole 16.

Figure 4:
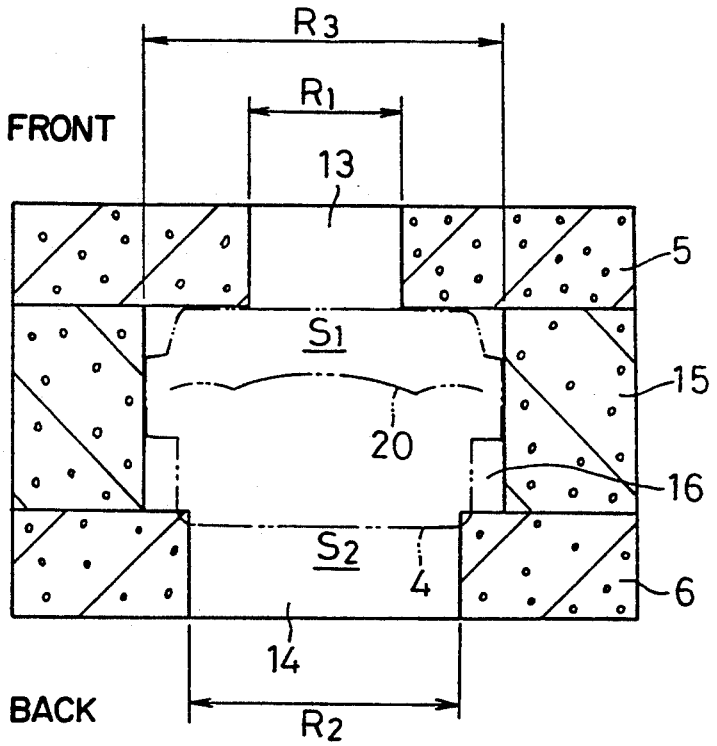
FIG. 4 is a schematically cross sectional view for explaining a construction of the essential part.

FIG. 4 is a schematically cross sectional view illustrating a mutual relationship relative to these first, second and third elastic supporting members 5, 6 and 15. As apparent from this illustration, a diameter $R_1$ of the through hole 13 is defined smaller than a diameter $R_2$ of the through hole 14 and the diameter $R_2$ of the through hole 14 is defined smaller than a diameter $R_3$. Thus, the relationship is indicated as $R_1<R_2<R_3$ and also sizes of each opening area thereof are predetermined to be the same relationship. These through holes 13, 14 and 16 are adapted to form a continuous formed through hole in cooperation with each other. The inner space of the through hole 16 is partitioned by a vibrator plate 20 of the microphone 4 into a smaller front space $S_1$, which communicates with the through hole 13, and a larger back space $S_2$ which communicates with the through hole 14. The smaller front space $S_1$ is predetermined to be smaller in volume than the larger back space $S_2$. These spaces $S_1$ and $S_2$ are communicated through the first and second filters 11 and 12 with the front slot 7 and the back slot 10, respectively. The microphone 4 is opened at the front side and and the back side thereof and surrounded at the periphery thereof by the elastic supporting member 15 so that a pair of sound paths are formed only at the front side and at the back side of the microphone 4 by each of front and back spaces $S_1$ and $S_2$. Further, as shown in FIG. 4, the spaces $S_1$ and $S_2$ are predetermined to have a sound pressure characteristic of the sideward noise made flat through resonance. A mutual relationship between the sizes of the opening areas of the through holes 13 and 14 and the volumes of the spaces $S_1$ and $S_2$ are set in such a state that each of the sideward noises diverging into the front side and the back side of the microphone device shows the sound pressure characteristic of substantially symmetrical curve at each side of the vibrator plate 20.

When explaining the detailed construction of the microphone 4 with reference to FIG. 1, the microphone 4 is contoured with a front cover 18 and a back cover 19. On the front cover 18 there are formed a plurality of slots 17. Within a space defined by the front and back covers 18 and 19 are accommodated the diaphragm or vibrator plate 20, a moving coil 21 integrally engaged with the diaphragm or vibrator plate 20, a magnet 22 and a support plate 23, or the like as unit component parts. A center hole **23*a* is formed on each center of the magnet 22 and the support plate 23 so as to function as a sound path inside of the microphone 4 which communicates between a back side central portion 20*a* of the diaphragm or vibrator plate 20 and the larger space $S_2$ of the through hole 14. The support plate 23 is provided on a flange 24 thereof with a plurality of small bores 25. The bored flange 24 is fixedly held together with a sponge ring 26 of an air ventilating material sticked thereon between the periphery of the front cover 18 and the periphery of the back cover 19. The small bores 25 and the sponge ring 26 are adapted to form a sound path inside of the microphone 4 which extends from the back side of the microphone 4 to the peripheral portion 20*b* of the diaphragm or vibrator plate 20. A lead wire 27 connected to the support plate 23 is lead out of a wiring hole 19*a* of larger diameter formed on a bottom center of the back cover 19**.

Figure 5:
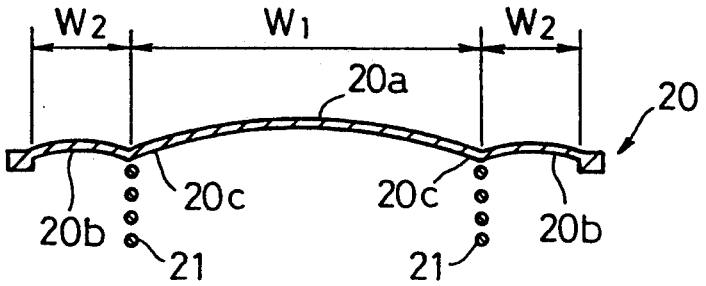
FIG. 5 is a schematically cross sectional view for explaining a construction of an essential part.

FIG. 5 shows a cross sectional view of the diaphragm or vibrator plate 20 in an enlarged scale. The diaphragm or vibrator plate 20 comprises the central portion **20*a* and the peripheral portion 20*b* formed concentrically and integrally with each other. The center portion 20*a* is formed with a curvature different from that of the peripheral portion 20*b* and with a larger diameter $W_1$ far beyond a radial length $W_2$ of the peripheral portion 20*b*. An end of the moving coil 21 is engaged with a bent portion 20*c* which is a connection between the central portion 20*a* and the peripheral portion 20*b* of the diagram vibrator plate 20**.

Figure 6:
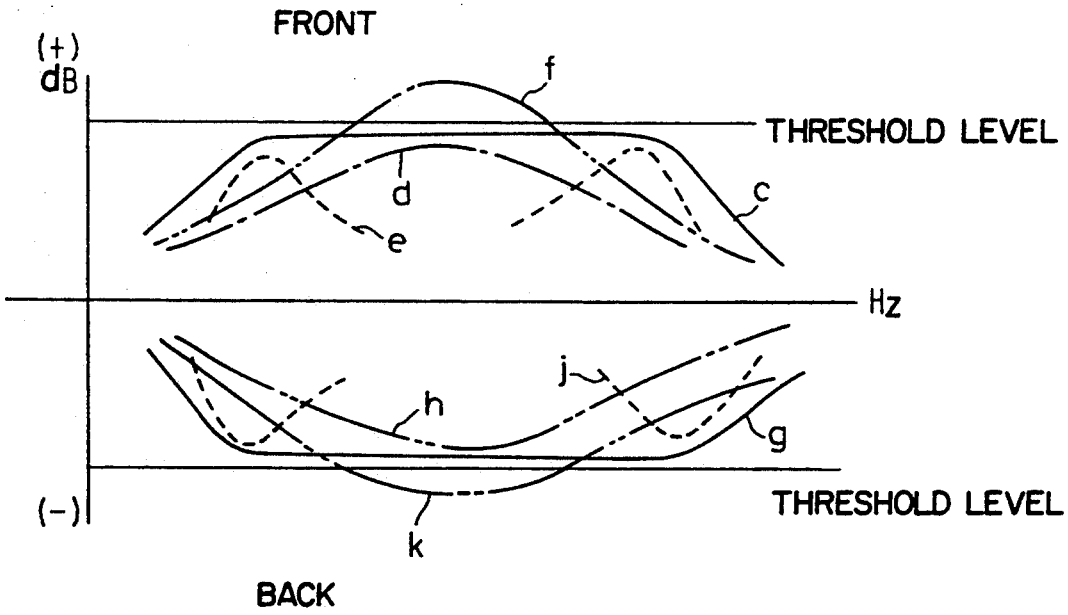
FIG. 6 is a diagrammatical illustration for explaining an operation of the present invention.
Figure 7:
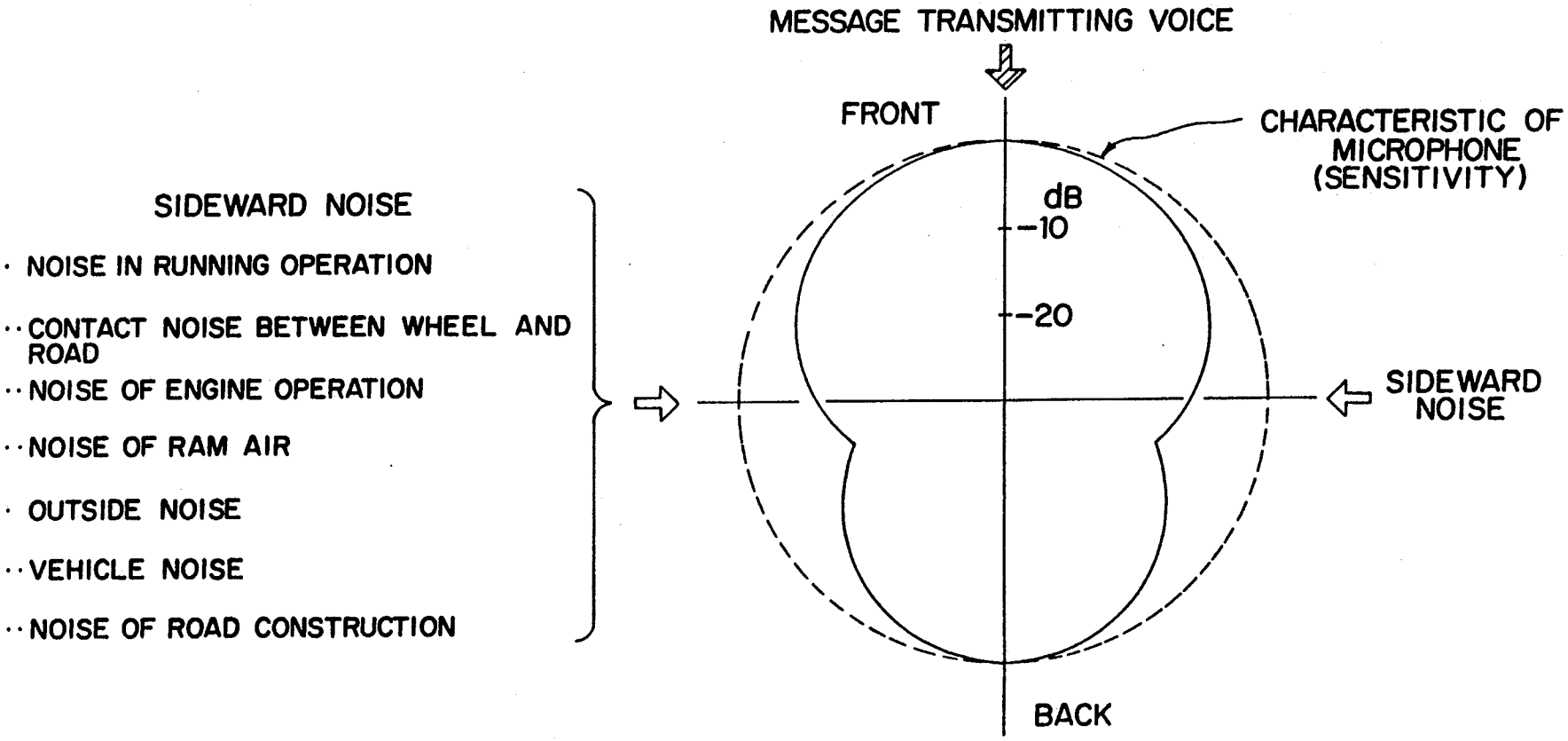
FIG. 7 is a diagrammatical illustration showing a directional characteristic of a microphone device pursuant to the present invention.

Next, an explanation will be given on the operation of the embodiment. Referring to FIG. 1, when a sideward noise reaches the close talking microphone device 1 simultaneously with a message transmitting voice, it is diverged into the front side and the back side of the microphone device 1 as shown by course lines "a" and "b". The diverging noise of the course "a" flows through the front opening slot 7, the first filter 11, the through hole 13 and the slots 17 into the inside of the microphone 4. The diverging noise of the course "b" flows through the back opening slot 10, the second filter 12, the through hole 14 and the wiring hole **19*a* of the back cover 19 into the inside of the microphone 4, passes through the peripheral sound path, comprising the sponge ring 26 and the small bores 25, and the central sound path, comprising the central hole 23*a* formed on the support plate 23 and the magnet 22 therethrough, and reaches the back side of the diaphragm vibrator plate 20. As explained above, the sideward noise, therefore, enters only from the opposed front side and back side of the microphone 4. The diverged noises flow only through the smaller space $S_1$ and the larger space $S_2$, respectively, thereby substantially simultaneously reaching the diaphragm vibrator plate 20. Each of the diverging noises reaching the diaphragm or vibrator plate 20, as apparent from FIG. 6, is dampened by the first and second filters 11 and 12 so that the peak of the sound pressure may be positioned less than the threshold level. The diverging noises resonate within the smaller space $S_1$ and the larger space $S_2$ so that each curve of the sound pressure characteristics may be flattened. At the same time, the curves "c" and "g" of the sound pressure characteristics of each diverging sideward noise are formed substantially symmetrical to each other at each side of the diaphram or vibrator plate 20 by differences in size between the through holes 13 and 14 and in volume between the spaces $S_1$ and $S_2$. Accordingly, the diverging noises coming from the courses "a" and "b" are cancelled with respect to each other when reaching the diaphram or vibrator plate 20 respectively from the front side and the back side, whereby the sideward noise as a whole may be remarkably lessened. Thus, the microphone device 1 will be provided with a low sensitivity in the side direction and with a particular directivity of substantially the shape of the number "8" as shown by a solid line in FIG. 7, thereby easily cutting the sideward noise. In the drawing, a phantom line shows sensitivity in the case where no directivity occurs. Further, as explained in FIG. 5, the diaphram or vibrator plate 20 has a close talking type characteristic which is hard to be sensitive to the sound of low sound pressure, since the radial length $W_2$ of the peripheral portion 20*b* is less than the diameter $W_1$ of the central portion 20*a*** ($W_1 > W_2$). Therefore, the remarkably dampened noise is hardly picked up and only the message transmitting voice of high sound pressure from the front side is possible to be effectively picked up. As a result, the sideward noise of a large obstacle to the message transmission on the motorcycle and especially other vehicle noise may be effectively reduced so as to clearly transmit the message transmitting voice.

The thickness or material of the first and second filters 11 and 12, opening sizes of the through holes 13 and 14, and volumes of the spaces $S_1$ and $S_2$ will be changed, depending on various circumstances. Therefore, they are to be selected and determined by calculations and experiments in accordance with each embodied construction of the microphone device.

The larger space $S_2$ in this embodiment is connected to the central hole **23*a* so as to function as a damper when a large sound pressure is imposed on the front side of the diaphragm or plate 20. The air sponge ring 26 forms the sound path for communicating the diverging noise of the course "b" from the small bores 25 to the back side periphery 20*b* (FIG. 5) of the diaphragm or vibrator plate 20. The sponge ring 26 is adapted to support the flange 24 without vibration so as to function as a damper for the vibrator plate 20 of a different characteristic from the central hole 23*a*. The characteristic of this dampening function is easily adjustable by changing a material, thickness and ventilating level or the like of the sponge ring 26. The first, second and third elastic supporting members 5, 6 and 15 are compressively arranged in a preloaded condition between the front casing 2 and the back casing 3 so that the microphone may be closely supported and that the sound turning to the lateral side of the microphone 4 may be effectively sealed. As the first, second and third elastic support members 5, 6 and 15 are formed into three divided layers, they may be easily produced even if the diameters $R_1$, $R_2$ and $R_3$ of the through holes 13, 14 and 15** are different from each other.

Although there have been described what are at present considered to be the preferred embodiment of the present invention, it will be understood that the invention may be embodied in other specific forms without departing from the essential characteristics thereof. The present embodiment is therefore to be considered in all aspects as illustrative, and not restrictive. The scope of the invention is indicated by the appended claims rather than by the foregoing description.

What is claimed is:

1. A close talking microphone device in use for a communication apparatus for a motorcycle comprising a front casing adapted to be positioned adjacent to a mouth of a user and being provided with an opening for transmitting a sound, a back casing being adapted to be combined with said front casing in a face to face relationship to form a space for accommodating therein a microphone, an elastic supporting means being formed of an air infused material and being accommodated in said microphone accommodating space, and said microphone being adapted to be supported by said elastic supporting means in a floating state, characterized in that a diaphragm of said microphone is provided with a central substantially circular portion and an outer peripheral portion concentrically and integrally formed with said central substantially circular portion, said outer peripheral portion having a radial length smaller than a diameter of said central substantially circular portion and formed with a surface of different curvature from said central substantially circular portion, a moving coil being engaged at an end thereof with a bent portion between said central substantially circular portion and said outer peripheral portion of said diaphragm, that a through hole formed at the center of said elastic supporting means, said microphone being engagingly arranged within said through hole so as to divide a space of said through hole into a front sound path and a back sound path with respect to said diaphragm of said microphone, and said front sound path being defined smaller in size and volume than said back sound path, and said elastic supporting means compressively accommodated within the space of said casing in such a state that the same is in abutment through a first filter with said front casing at the front end thereof and through a second filter with said back casing at the back end thereof, said back casing being formed with an opening thereon, and said through hole being in communication through said first and second filters with each opening of said front casing and said back casing.

2. A microphone device as set forth in claim 1, wherein a substantially central opening is formed on a substantially center of said microphone so as to communicate between the back side of said diaphragm and the backward area of said through hole with respect to said microphone.

3. A microphone device as set forth in claim 1, wherein said microphone is provided with a flange for supporting said outer peripheral portion of said diaphragm, a plurality of small bores being formed on said flange and positioned on an air infused elastic member, and a sound path is formed through said small bores and said elastic member to communicate between the back side of said peripheral portion of said diaphragm and the backward area of said through hole with respect to said microphone.

4. A microphone device as set forth in claim 1, wherein said elastic supporting means is formed with three separate pieces comprising a first elastic support which is in abutment through said first filter with said front casing, a second elastic support which is in abutment through said second filter with said back casing, and a third elastic support which is arranged between said first and second elastic supports so as to carry thereon said microphone.

5. A microphone device as set forth in claim 4, wherein said first, second and third elastic supports are provided at each center thereof with a first, second and third through holes connected to each other, said first through hole being defined smaller in diameter than said second through hole and the latter being defined smaller in diameter than said third through hole.

6. A microphone device as set forth in claim 1, wherein said front casing and said back casing are produced with a common die to be formed into the similar configuration to each other.

* * * * *